United States Patent [19]

Olsson

[11] 4,086,952

[45] May 2, 1978

[54] METHOD FOR PRODUCING A UNIFORM CRYSTAL STRUCTURE BY CONTINUOUS CASTING

[76] Inventor: Erik Allan Olsson, Oerlikonerstrasse 88, Zurich, Switzerland

[21] Appl. No.: 622,970

[22] Filed: Oct. 16, 1975

[30] Foreign Application Priority Data

Nov. 1, 1974 Switzerland ..... 014658/74

[51] Int. Cl.[2] ..... B22D 11/06; B22D 11/124

[52] U.S. Cl. ..... 164/88; 164/87; 164/419; 164/420; 164/429; 164/443

[58] Field of Search ..... 164/87, 88, 276, 278, 164/279, 275, 86, 419, 420, 427, 429, 437, 440, 443

[56] References Cited

U.S. PATENT DOCUMENTS

| | | | |
|---|---|---|---|
| 3,089,208 | 5/1963 | Scribner | 164/87 |
| 3,145,119 | 8/1964 | La Force et al. | 164/86 X |
| 3,354,937 | 11/1967 | Jackson | 164/278 X |
| 3,666,537 | 5/1972 | Williams | 164/86 X |
| 3,971,123 | 7/1976 | Olsson | 164/276 X |

FOREIGN PATENT DOCUMENTS

| | | | |
|---|---|---|---|
| 16,716 of | 1893 | United Kingdom | 164/275 |

OTHER PUBLICATIONS

Handbuch des Stranggiebens, 1958, p. 93.

*Primary Examiner*—Francis S. Husar
*Assistant Examiner*—Gus T. Hampilos
*Attorney, Agent, or Firm*—Parmelee, Miller, Welsh & Kratz

[57] ABSTRACT

A method of the conversion of a heat of molten metal, especially steel, into a finished product forms a continuous primary strand of solidified metal from a heat and then applies one or more successive layers of molten metal from the same heat to one or both sides of the primary strand under conditions where the additional layers alloy or integrate with the primary strand, the composite strand, like the primary strand, being quickly solidified to develop throughout the body a fine grain structure characteristic of a thin layer of metal that quickly chills from a molten state.

5 Claims, 13 Drawing Figures

40
41
42
43
43a
44
45
45a
46
47
48
49
49a
50
51
52
54
55
56
A
B

METHOD FOR PRODUCING A UNIFORM CRYSTAL STRUCTURE BY CONTINUOUS CASTING

This invention is for an improvement in a method of and apparatus for the continuous casting of molten metal, particularly steel, including steel alloys, by the formation of a primary strand of the metal from a heat of such metal on a chill surface followed by the application to the formed and at least partially-cooled strand of one or more layers of molten metal from the same heat, with solidification and partial cooling of a succeeding layer to the strand before the application of the next layer, and may be practised in conjunction with the inventions disclosed in my copending U.S. applications Ser. No. 604,428, filed 8-13-75, now U.S. Pat. No. 4,020,890, and Ser. No. 604,430, filed 8-13-75, now U.S. Pat. No. 3,976,117.

It is of course well known that the rate of solidification of molten steel in a mold decreases approximately as the square root of the elapsed time from the beginning of the solidification. As the thickness of the solid metal increases, the rate of solidification slows because of the increased distance between the molten metal and the relatively cool mold walls to which the heat must be transferred. This results in certain undesirable phenomena, such as the rejection from the slower-forming crystals of alloying ingredients that are retained when the metal solidifies rapidly and the formation of large dendritic crystals. Therefore, in the subsequent transformation of the solidified metal into a finished product, more extensive rolling or forging and/or heat treatment must be effected to secure the intended metallurgical qualities in the finished article than would be necessary if the rate of heat transfer during solidification were more uniformly like that which occurs in the initial layer of chilled metal over the outside of the ingot or other casting. To secure increased tonnage, industry has largely gone to the production of large section ingots that require extensive heat treating and more rolling or forging stages than would be necessary if the grain structure were uniformly of the high quality that exists in the chill zone or outermost shell of the ingot. For example, metal of the quality of metal in the chill zone would allow much heavier reduction in each roll pass without rupturing the metal than is presently permitted.

Continuous casting has made it practical to produce castings of smaller section but, for a given tonnage, this requires more strands to be simultaneously cast and introduces other problems.

For several decades many proposals, mostly in the form of patents, have been published aiming at transforming molten metal, often termed "a heat" or a "a melt" more nearly or completely to a finished product. Few of these have given much promise of success, and this has been confined principally to the non-ferrous industry. There are many reasons why these failed or were impractical, which it is here unnecessary to detail. In those processes involving the formation of plural strands which are subsequently united by fusion welding or by dip casting on a preformed core, separation of the metal layers were common causes of failure, and uniformity of composition was another cause. These procedures had more the attributes of metal plating than the formation of an integrated body of metal from a common heat in which a transition zone consisting of an actual alloying of two or more layers results, and because of this lack of alloying separation of the layers was a common defect.

The present invention relates to procedures similar in some respects to dip-casting and fusion-welding, but the solidification of the metal in the initial strand, followed by subsequent applications of additional metal as rapidly as possible to eliminate appreciable accumulation on the solidified surface products that prevent effective alloying or bonding of the applied metal to the previously-developed strand, and at the same time the initial strand and subsequently applied metal are rapidly chilled at each stage to obtain the fine uniform grain crystal structure throughout the resulting product, that is important from the standpoint of uniformity of composition and improved ability to be rolled or forged into some final shape. As a result, products of relatively small cross-section can be cast with less expensive equipment and less work is required in the conversion of the resulting strand to finished products.

Briefly stated, the invention involves first the forming of a continuous strand or strip by first producing an initial or primary strand of metal from a heat of liquid metal, chilling the strand so formed to a temperature of the order of 1000° F. or lower, immediately applying to this initial strand molten metal from the same heat, preferably while protecting the surface of the original strand from oxidation or accumulation of impurities or gases that will interfere with bonding of this applied metal to the original strand and subjecting the resulting body to light pressure while cooling it either for the addition of more molten metal or for subsequent exposure to the atmosphere. This is accomplished either by the enclosure of the apparatus in an inert, non-oxidizing or reducing environment and/or the use of deoxidizing media. In any case the applied metal and the original strand are developed from the same heat of molten metal except perhaps, in continuous operation where, for a brief interval, one ladle or supply source is becoming exhausted and a fresh one must be introduced. The molten metal so applied to the strand may be applied by flowing molten metal onto the surface of the original strand or by dipping.

The invention may be more fully understood by reference to the accompanying drawings which illustrate schematically several variations of apparatus embodying the invention and method of practising the invention.

Figure 2:
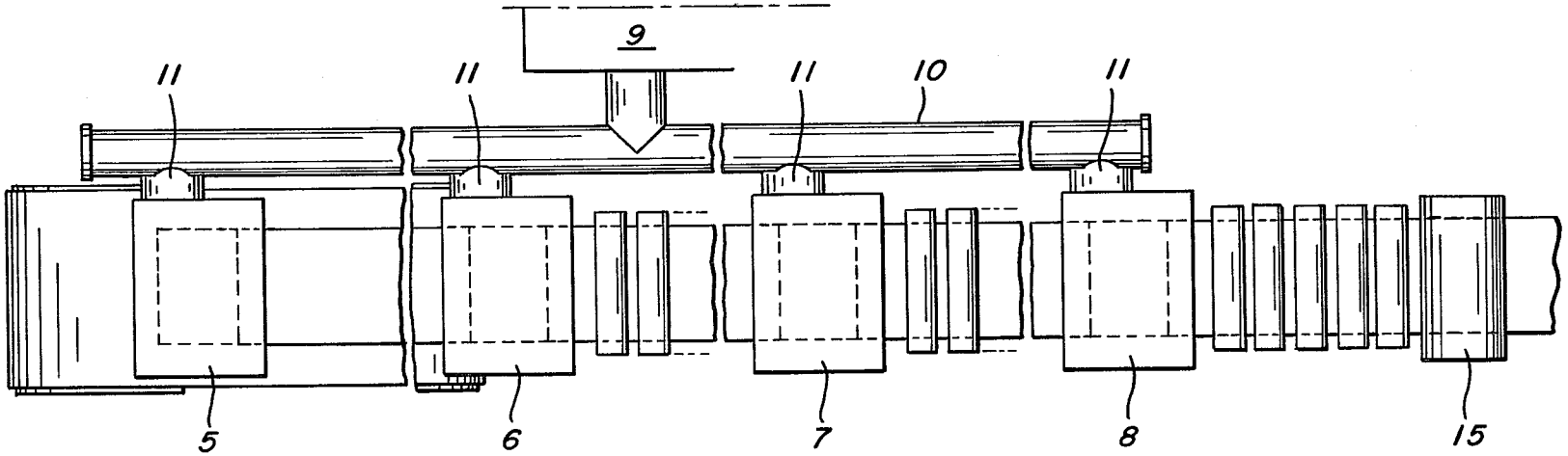
FIG. 2 is a top plan view of the apparatus shown in FIG. 1.
Figure 3:
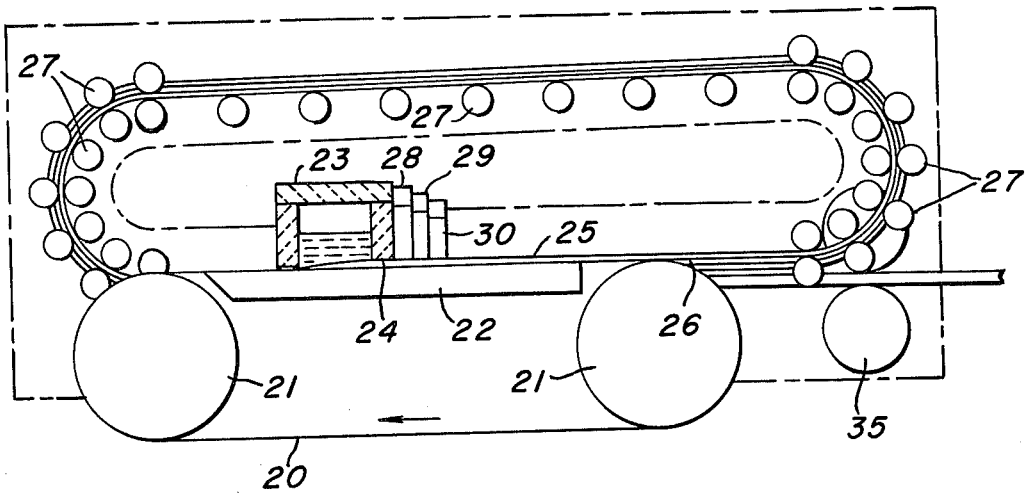
Figure 4:
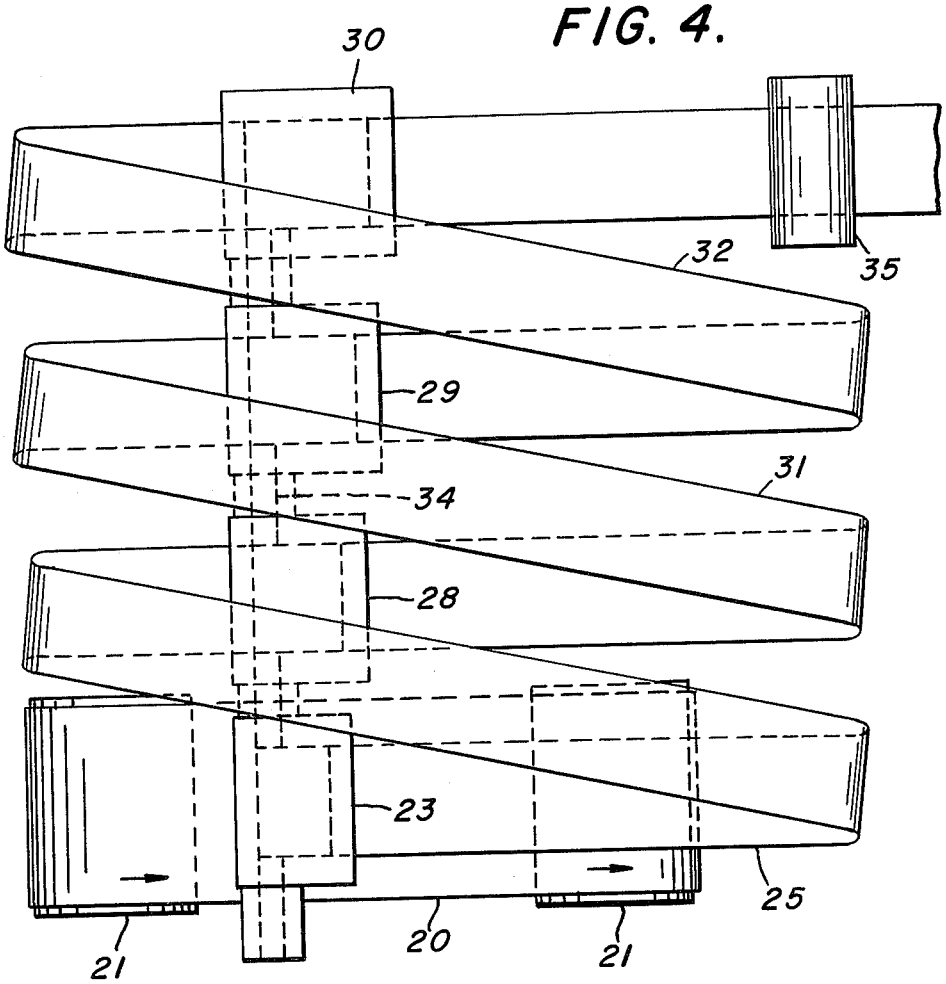
Figures 5, 6, 6A, 6B:
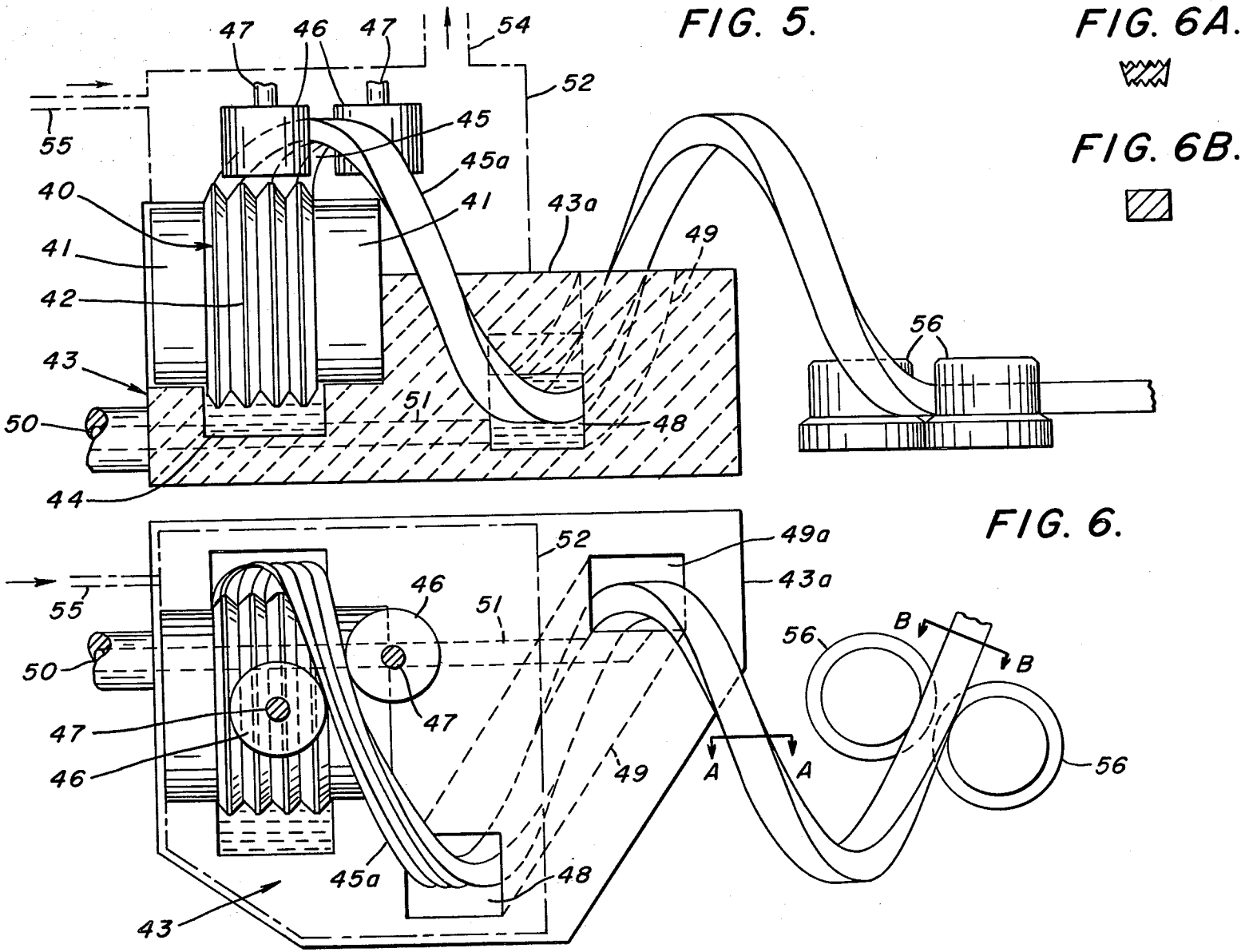
Figure 7:
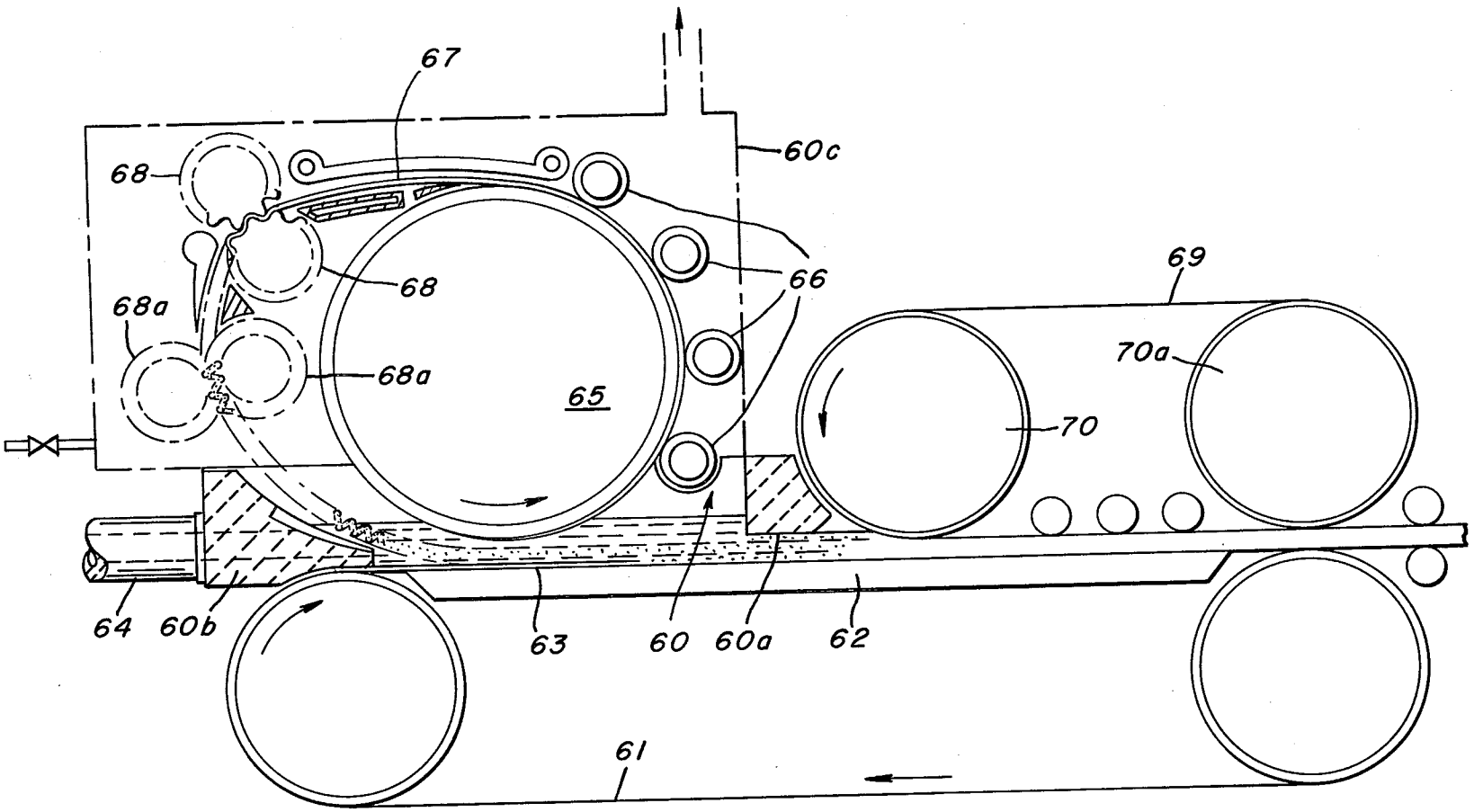
Figure 8:
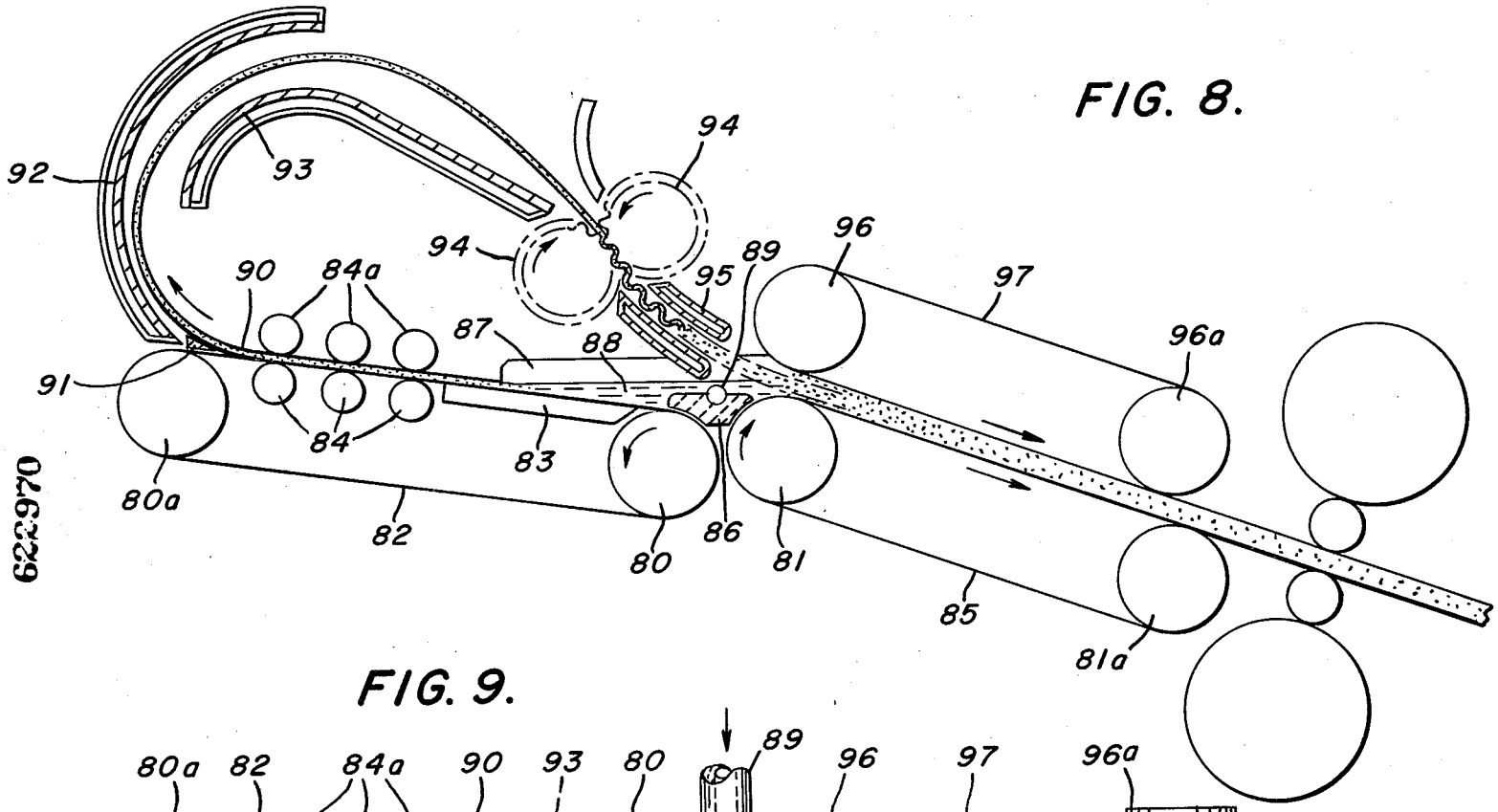
Figure 9:
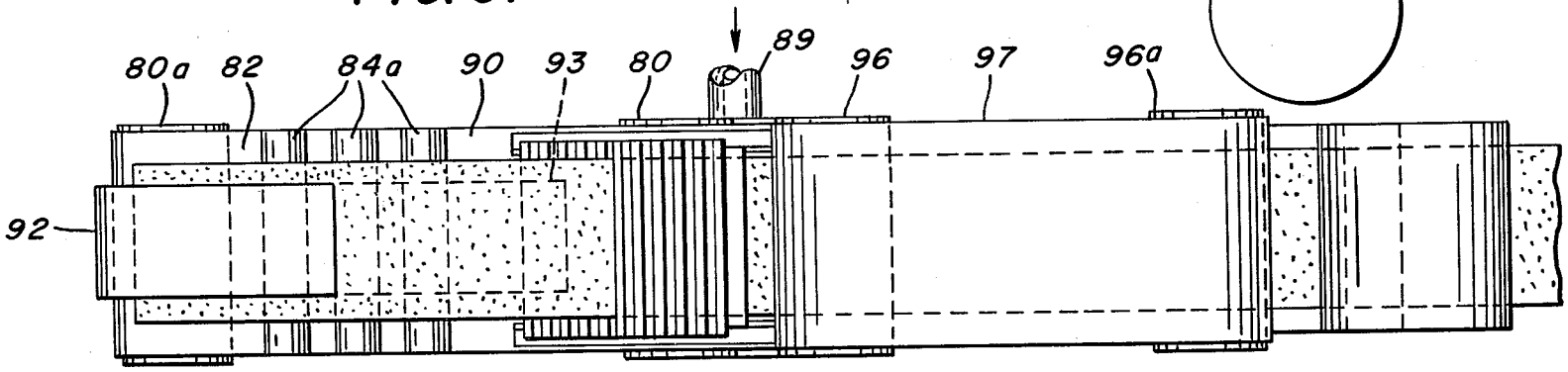
Figure 10:
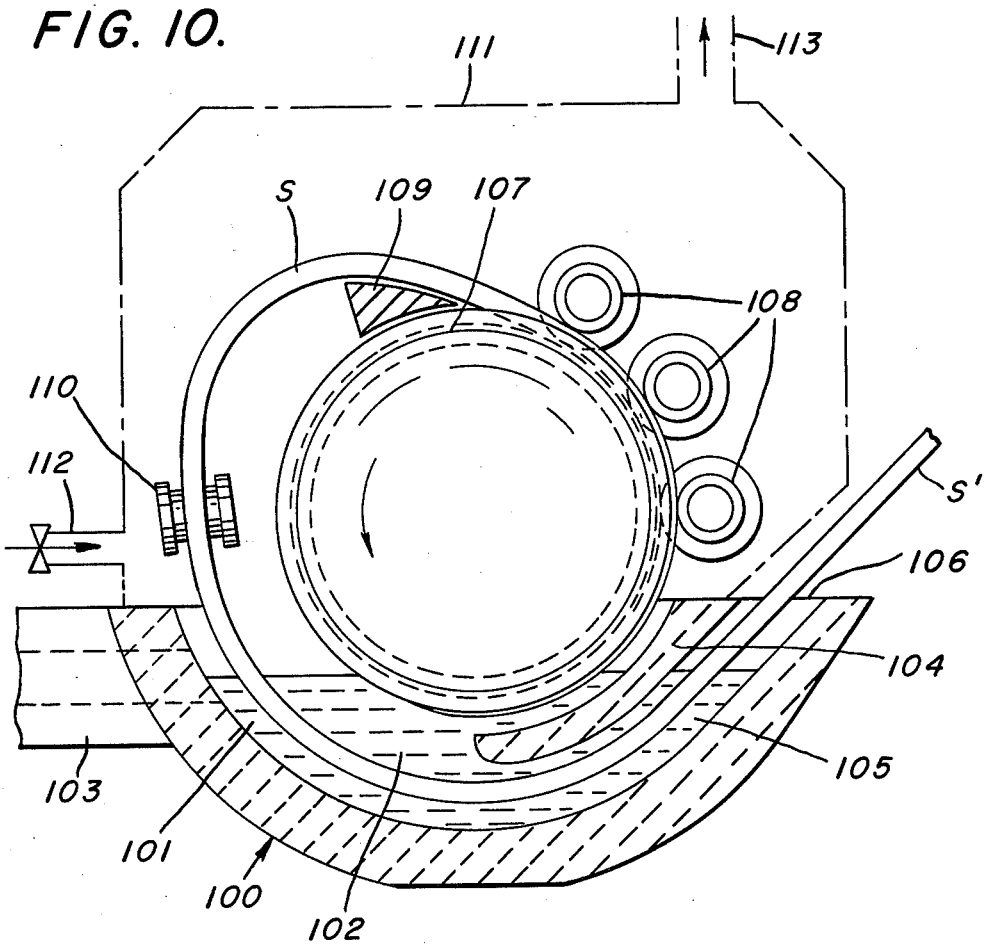
Figure 11:
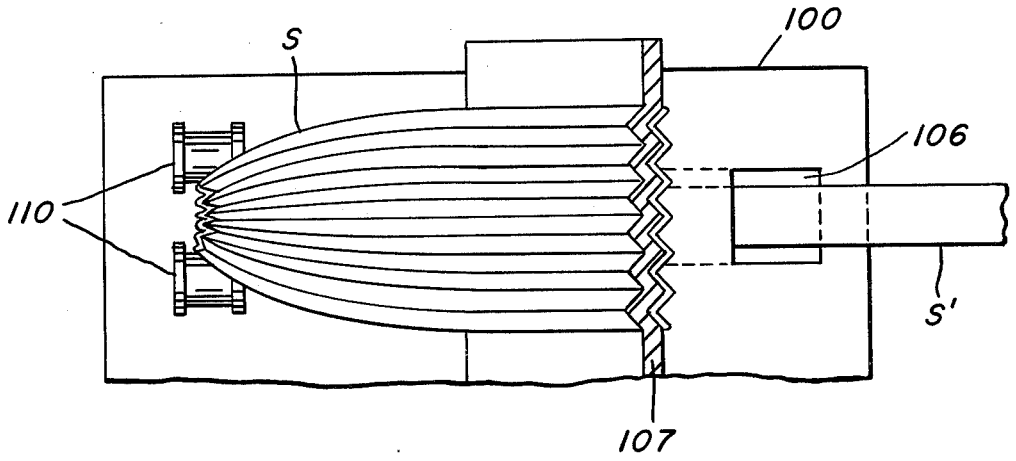

FIG. 3 shows schematically a modification of the arrangement shown in FIGS. 1 and 2 wherein the successive containers from which the hot metal is applied to an initial supporting belt and subsequently to the strand from hot metal containers in side-by-side relation instead of longitudinally-spaced containers as in FIGS. 1 and 2, thereby reducing the distance separating one molten metal container from another and consequently the distance from the hot metal supply source to the most remote container in the series;

FIG. 4 is a plan view of the apparatus of FIG. 3;

FIG. 5 shows another form of apparatus where the cold surface on which the melted metal is first solidified in a revolving roll instead of a belt, as in the preceding figures, the view being generally a longitudinal section, but for purposes of illustration certain parts are in elevation;

FIG. 6 is a top plan view of the apparatus as shown in FIG. 5;

FIGS. 6A and 6B are transverse sections through the casting in the plane of lines A—A and B—B respectively of FIG. 6;

FIG. 7 is a schematic view of another variant wherein the primary strand is solidified not only from the same melt as the layer which is subsequently applied to the strand, but with the molten metal being confined in a single container, the view being generally a longitudinal section;

FIG. 8 is also a schematic longitudinal section showing a further modification wherein the primary layer is formed on a traveling belt, corrugated, and then exposed to the same body of molten metal from which it is formed with the molten metal solidifying between the folds or valleys on both sides of the corrugated primary strand;

FIG. 9 is a top plan view of the apparatus of FIG. 8;

FIG. 10 is a schematic transverse vertical section through another form of apparatus where the primary strand is formed having a saw-tooth or corrugated periphery, with a roll arrangement for partially squeezing the corrugations on the resulting primary strip closer together followed by passage of the primary layer or strip through the bath of molten metal to fill the voids between the corrugations, the parts of the apparatus for rolling and straightening the product not being shown; and FIG. 11 is a schematic top plan view of a portion of the apparatus shown in FIG. 10 illustrating how the primary strand is reduced in width and the emergence of the final strand from the container.

Figure 1:
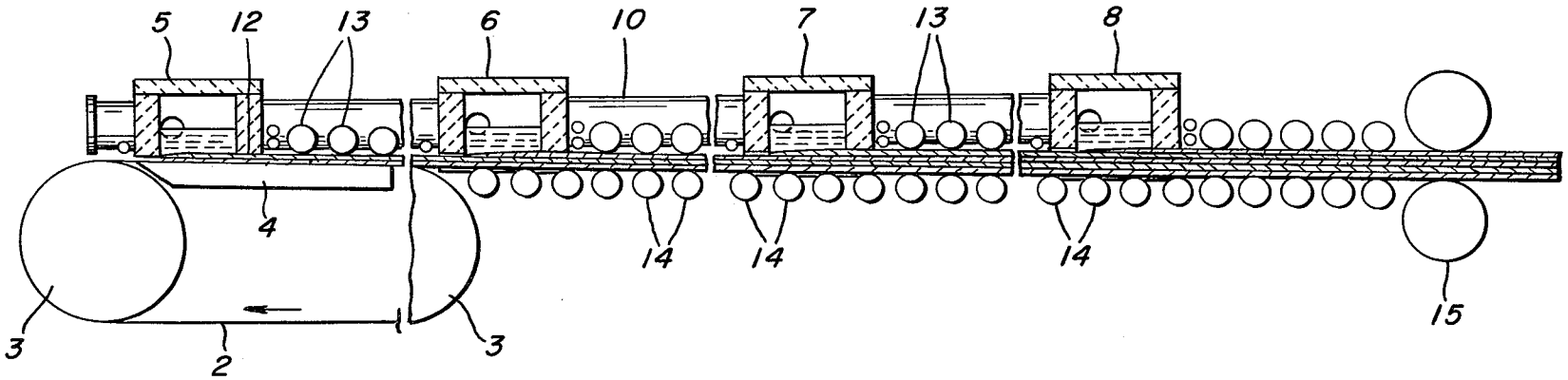
FIG. 1 represents schematically a longitudinal section through one form of strand casting apparatus embodying the present invention.

In FIGS. 1 and 2 there is disclosed an in-line arrangement where there is a chilled support on which a layer of molten metal is first deposited, and this layer, after solidifying, is stripped from the support and then travels as a supporting strand beneath a succession of containers separated by intervening cooling stations where additional layers of molten metal are alternately supplied to the strand and cooled until a strand of the desired thickness resulting from the several successive integrated layers has been produced.

As here illustrated in a more or less schematic fashion, there is an endless belt 2 that passes around rolls 3, one of which is driven at a constant speed by conventional drive means (not shown). The belt may be formed of steel or other flexible heat-resistant material. The upper reach of the belt passes over a flat water-cooled support 4. Above the upper reach of the belt there is positioned the first of a series of spaced tundishes or hot metal discharge containers, numbered successively 5, 6, 7 and 8. They are supplied with molten metal from a reservoir 9, such as a ladle or furnace through a manifold 10, the manifold having an outlet 11 to each of the containers so that substantially all metal supplied to the containers is derived from the same heat and has the same composition.

The containers 5 and 8 are of like construction, being generally rectangular with their length extending crosswise of the belt 4. Each is open at the bottom with a narrow slit or opening 12 under the downstream side wall, that is, the side toward which the belt and strand travels. Since it is the function of each container to supply a layer of molten metal to the congealed metal constituting the strand, each container is effectively elevated the thickness of the strand entering beneath it above the preceding one to provide clearance for the increased thickness of the entering strand.

Following the first container 5, as here illustrated, and above the top reach of the belt 2 are means providing a cooling station in advance of the next container which as here shown comprises water-cooled rolls 13 or other water-cooled surface to cool the upper surface of the layer of metal that forms on the upper reach of the belt over water-cooled support 4.

Just beyond the right or discharge end of the belt there is shown the second container 6. The layer of metal formed and solidified on the upper reach of the belt, now constituting the primary strand on which additional metal is collected, is stripped from the belt and from this point on is supported only by water-cooled supporting means as indicated by the continuous succession of closely-spaced water-cooled rolls 14, extending one after another for a distance beyond the last container 8 of the series. Between each two containers there are upper cooling elements or means, which are here indicated as water-cooled rollers 13 similar to those between the first two containers. While the strand is supported throughout its length on water-cooling support means, there are cooling stations between each two containers and following the final one where accelerated cooling is effected at the top and bottom, with desirably some slight pressure to smooth and level the newly-applied metal as the strand emerges with an added layer from beneath each container. After leaving the final cooling station the strand may be converted to a finished bar or strip as indicated by rolls 15, but if necessary it may first be reheated to a normal hot-rolling temperature, or it may be first cut into convenient lengths, as may be required.

Briefly, however, the operation and the method as here disclosed involves first the supplying of molten metal to a primary supporting surface, in this instance an endless belt to which the molten metal does not adhere to form a continuous cast strand to which subsequent layers of molten metal are added and solidified in sequence until a strand of predetermined desired thickness has been developed. There will be no appreciable variation in the composition of the metal from layer to layer and each layer is applied after the previous layer has been cooled, preferably to a temperature at least as low as about 1000° F. so that rapid solidification of each layer will take place to develop the desired fine grain structure obtained by the quick solidification of molten steel against a chill surface. While conduction of heat from each layer downward through the strand will occur less rapidly as the thickness of the strand increases and the strand moves at uniform speed under each container, rapid solidification is also secured by top-cooling as the strand emerges from beneath each container, and if necessary the containers could be spaced increasingly greater distances to assure the temperature of the thicker strand being cooled before it moves under the next container.

The practice of the invention thus provides a method wherein a strand is formed on a moving chill surface from which it is preferably stripped and the thickness of the strand increased in successive increments, preferably thin increments of uniform thickness, after the strand is first cast on the moving chill surface. Because the first layer and each added layer is supplied from the same "heat" or "melt" of metal and with minimum opportunity for surface contamination of the solidified layer, the added layer of liquid metal bonds to the underlying layer, and to assure this an inert, non-oxidizing or even a deoxidizing atmosphere may be maintained around the operation, as disclosed in some of the other figures of the drawings, hereinafter described. Also, the belt 2 could be lengthened as well as the cooled supporting member 4, so that the cast strand would travel under the second container 6, as well as the first, and thereby be stronger before it travels under successive containers without other rigid support. The belt, of course, could extend under other containers; but inasmuch as it adds its thickness to the complete casting being formed even though the casting is ultimately stripped from the belt, it still is present as an added layer through which heat must be withdrawn to secure the chill-zone thickness of metal in each layer. As before explained, the thicker the casting the slower the cooling, and the slower cooling results in the formation of larger crystals, which result is to be avoided. Therefore it is desirable ordinarily at least that the primary strand be removed from the supporting belt as soon as it can be done without impairing the operation.

The flow of metal from the container and its spread over the supporting strand may be controlled by generating an alternating electromagnetic field about the containers as disclosed in the aforementioned copending applications which are incorporated insofar as they are relevant in this application by reference.

The example shown in FIGS. 1 and 2 requires a relatively large distance between containers so that it may be necessary to use inductive heating or resistance heating along the manifold or distributing channel 10 to assure reasonably uniform fluidity of the metal from the first container to the last. To avoid or reduce such need and secure close side-by-side positioning of the containers, an arrangement such as shown in FIGS. 3 and 4 may be provided.

In the example shown in FIGS. 3 and 4, there is an endless belt 20 passing around spaced rolls 21, one of which is driven at a predetermined constant speed, as is the belt in FIGS. 1 and 2, by drive means (not shown). The upper reach of this belt passes over, and is supported between the rolls 21 on a water-cooled plate or panel 22. There is a first container for molten metal located over the belt, as indicated at 23. It is shown in section in FIG. 1. As in FIG. 1, the container has no bottom except that provided by the water-cooled belt and its downstream side wall clears the belt at 24 to provide clearance for the continuous layer 25 of solidified metal emerging from beneath the container. This continuous layer is stripped from the belt as a continuous strand at 26 and looped up and laterally around cooled guiding and supporting rolls 27, the loop being guided by supporting rolls to pass under molten metal container 28, corresponding to container 6 of FIG. 1, but positioned beside container 23. Container 28 applies a layer of molten metal to the continuous strand which is then looped in the same fashion as the initial strand to travel beneath other containers, such as 29 and 30, the successive loops being designated 31 and 32.

There is a molten metal inlet duct 33 leading from a source of supply (not shown) into container 23, and container 23 and each succeeding container, except the last, is connected to the next-adjacent container by duct 34 so that all of the containers, now in close side-by-side relation, receive metal from a common source. Each container, beginning with the second container, is desirably lower than the preceding one in order that the containers may be emptied by emptying container 30. This of course results in the strand under each successive container being at a lower level than the preceding one, and it will be seen in FIG. 3 the emerging strand is at a lower level than the first.

With this arrangement there can be a relatively long travel for the strand from one container to the next, but a short distance separating the first container from the next, all being relatively close in side-by-side relation. The broken lines around FIG. 3 indicate an enclosure for maintaining a controlled atmosphere in which the formation of the strip is effected. A final roll pass is indicated at 35.

In FIGS. 5 and 6 there is shown schematically the formation of the original strand on a dip roll instead of on a travelling belt as in the preceding figures, stripping the strand as a helix from the roll and then dipping it one or more times through a bath of molten metal. It also discloses a procedure where the original strand is formed with longitudinal corrugations, squeezed to more completely close the space between the corrugations, and then passed through a bath of molten metal to fill the spaces between the corrugations followed by shaping the strand to straighten it.

In FIGS. 5 and 6, 40 is a water-cooled roll with neck extensions 41 and driving means (not shown) for rotating it at a constant speed. The periphery 42 of the roll is serrated or corrugated, forming peripheral grooves and ridges. The roll is contained in a refractory or heat-resisting housing or container 43 with a trough 44 for holding a body of molten metal into which the periphery of the cooled roll dips to form a longitudinally-corrugated strand 45. Means (not shown) may be provided as shown in copending application Ser. No. 604,428 now U.S. Pat. No. 4,020,890 for preventing solidification of the metal at and adjacent the sides of the rolls by the repulsive force which an alternating current field will produce on molten steel.

There are a pair of spaced rolls 46 rotatable about vertical axes indicated by shafts 47 through which they are also driven in opposite directions. They provide a pass between them through which the corrugated strand, still hot as it comes off the periphery of the forming roll, is continuously moved, whereby the width of the casting is reduced by narrowing the grooves or valleys between the ridges on each side of the casting. The rolls are also set to bend the strand into a helix **45*a* that is guided down and through entrance passage 48 in portion 43*a* of the refractory body, emerging therefrom through a well or cavity 49 and exit passage 49*a***.

As shown in FIGS. 5 and 6, molten metal is supplied to the trough 44 through conduit 50, and conduit 51 through the refractory body conducts molten metal from the trough or duct 50 to the well or cavity 48 so that the strand **45*a*** passes through a bath of molten metal, so that by a dip procedure, molten metal from the same heat as that which forms the strand, fills the narrow grooves in the strand and forms around the strand, becoming an integral addition to the original strand with the new metal alloying to the original metal in the sense that the bond at the interface, as in the other modifications, becomes inseparable.

There is an enclosure 52 indicated by broken lines over the dip roll 40 and the rolls 46 so that a controlled atmosphere may be maintained over the strand-forming and shaping steps, this enclosure extending across the refractory body portion **43*a* sufficient to cover the entrance passage 48 where the strand enters the refractory body. The molten metal in the well or cavity 49 forms a seal to exclude atmosphereic air or other gases from entering into the space under the enclosure. A duct for withdrawing gases from under the hood is indicated at 54, and 55** indicates a pipe through which an inert gas may be supplied to the interior of the enclosure.

In FIGS. 5 and 6 there is shown only a single hot metal cavity 49, but the refractory portion 43*a* may be extended to provide one or more additional cavities, and of course the enclosure would be extended to but not over the final exit of the helix into the air. Also in FIGS. 5 and 6 the passage 51 could be omitted and a fluid to clean and deoxidize the metal could be used in the cavity in place of molten metal and a succeeding cavity would be supplied with molten metal.

When the strand finally emerges, it will pass between driven straightening rolls 56. Desirably the surface of the strand which formed against the dip 40 will be slightly wider than the outermost surface, as shown in FIG. 6A which is a section on line A—A of FIG. 6. As the strand is rolled between rolls 56 to equalize these dimensions to the shape shown in FIG. 6B, which is a section, after rolling, on line B—B of FIG. 6, the wider portion will be elongated more than the narrower portion and thereby remove any stress or camber in the casting due to the original unequal lengths of the inner and outer portions of the strand.

In the variation shown in FIG. 7, molten metal is supplied to a single container from which the primary strand is formed and all subsequent applications of molten metal derived.

In FIG. 7, a refractory container is designated 60 with front and rear walls 60*a* and 60*b* respectively, and side walls (not shown). The container has no bottom, but, as in FIG. 1, the upper reach of an endless belt 61 moving over a water-cooled supporting panel 62 forms a closure and moving chill surface 63 under the container provides a surface on which a thin layer of solidified metal continuously congeals from the pool of molten metal which is maintained in the container through duct 64.

Above the container is a cooled dip roll 65 which dips into the pool of molten metal in the container. As this roll is continuously driven by conventional drive mechanism (not shown), a layer of metal continuously solidifies on its periphery. After passing under cooled rollers 66 that smooth it and press it slightly, this layer of metal, which becomes the primary strand 67, is stripped from roll 65 and passed between corrugating rolls 68 by which it is transversely corrugated. From these rolls, the corrugated strand passes between rolls 68*a* that crowd or squeeze the corrugations together and deepen them. Rolls 68 and 68*a* are driven in synchronism by conventional means (not shown).

The corrugated strand, emerging from between rolls 68*a* is guided down into the pool of molten metal in the container to pass under dip roll 65. In this step the molten metal fills the crevices or valleys on both sides of the corrugated strip, producing a thick integral strand which comes to rest on the continuously-moving layer of solidifying metal simultaneously forming on the upper reach of the belt 61.

Molten metal flows from under the front or downstream of the container 60 against an endless belt 69 passing around rolls 70 and 70*a*, and on which another thin layer of the molten metal solidifies, and by which it is moved along with and pressed down against the emerging strand on the lower belt, so that the corrugated strand with the corrugations filled with metal, the lower layer of metal on belt 61, and the upper layer of metal on the undersurface of belt 69, all in condition for fuse-welding or actual alloying, are pressed together and integrated and cooled into a strip or continuous wide flat bar, the shape of which may be thereafter changed, but which is produced from a common melt in a single container with metal solidified rapidly in thin layers and inseparably bonded together. The speeds of the various components are related so that all the layers, as they come together, travel in isochronism, and these speeds must take into considerarion the shortening of the primary strand resulting from its being transversely corrugated. Conventional driving means for the belts and dip roll are not shown, but can be adjusted to the requirements also by conventional means.

There is an enclosure 60*c* over the container and dip roll and rolls 68 and 68*a* for maintaining a controlled inert or non-oxidizing atmosphere around the strand and molten metal as it is being integrated into a single continuous product.

Referring to FIGS. 8 and 9, there are shown two rolls 80 and 81 in side-by-side relation, but spaced from each other, and as indicated they revolve in opposite directions. There is an endless belt 82 that passes around roll 80 and which is inclined upwardly from roll 80 to pass around roll 80*a*. Since roll 80 revolves, as here illustrated, in a counterclockwise direction, the top reach of belt 82 moves upwardly. A cooling panel or support 83 shown under the right end of the upper reach of this belt and beyond these rolls 84 which are water-cooled rolls, are shown under said upper reach.

There is a second belt, 85, that passes around roll 81 and its upper reach slopes downwardly to pass around a lower roll 81*a*. There is a refractory insert 86 that sets on the emerging surfaces of the two belts 82 and 85 where they come up between rolls 80 and 81 and formed with this insert there are end walls 87. This insert with the end walls is arranged to retain a pool of molten metal, 88, that is supplied through duct 89.

Molten metal in the pool 88 solidifies on the surface of the travelling belt 82 as a continuous strand which is carried over rolls 84 and smoothed and pressed against the top of the belt by cooled rolls 84*a*. Near the upper end of the upper reach of the belt 82 this solidified strand of metal 90 is stripped by stripper element 91 and deflected in an arc between water-cooled curved guides 92 and 93 first upwardly and then in the reverse direction downwardly on an incline to pass between corrugating rolls 94 to emerge through water-cooled guide 95.

Above the roller 81 there is another roller 96 around which passes endless belt 97 with its lower end passing around roller 96*a*. The lower reach of belt 97 is spaced above and parallel, or nearly parallel, with the top reach of belt 85. The corrugated strand, emerging from guide 95, is directed into the space between belts 85 and 97, which travel in the same direction and molten metal from the pool 88 also flows into this space. This molten metal fills the valleys of the corrugated strand and quickly solidifies while layers of molten metal solidifying on the belts above and below the corrugated strip weld to the corrugated, metal-filled strand to form an integral continuous strand where the several layers now become an inseparable body, with all of th metal being supplied from the common pool 88 and therefore from the same heat of metal.

With this apparatus and process a plurality of solidified layers are brought together while immersed in the melt.

In FIGS. 10 and 11, there is a refractory container, designated generally as 100, in which is a trough-like cavity 101 to retain a body of molten metal, 102, such as steel that is supplied through duct 103. There is an integral partition 104 extending into the trough on the right side, as shown in FIG. 10, forming an outlet passage 105 terminating in opening 106 (see FIG. 11).

There is a peripherally-corrugated or serrated water-cooled dip roll 107, the low portion of the periphery of which is submerged in the molten metal 102. A continuous layer of metal forms on the dip roll which is rotated by means (not shown) at a continuous speed in the direction of the arrow in FIG. 10, which, as here shown, is counterclockwise. This layer is pressed and held in intimate contact with the cooled surface of the dip roll by corrugated rolls 108 which have peripheral corrugations that mesh into those of the dip roll and the layer of metal formed thereon. These rolls also roll and improve the surface of the continuous casting formed on the roll. After passing under the last of the rolls 108, the continuous longitudinally-corrugated strand S so formed is stripped from the surface of the dip roll with the aid of stripper 109 and directed into the pass between a pair of rolls 110 arranged to compress the width of the strand and narrow the valleys between the corrugation to secure a ratio of solid metal to open space in the strand favorable to the rapid solidification of the molten metal when the strip, after passing between the rolls 110, is directed into the body of molten metal 102 from whence, but only a brief time earlier, it had been formed. The strand is curved and guided to emerge through passage 105 and opening 106. As it moves through the body of molten metal, the molten metal fills the narrow grooves in the strand and quickly solidifies as the strand emerges through the opening 106.

As here shown the molten metal in the trough is level. There is an enclosure 111, indicated by broken lines, over the dip roll and trough containing the molten metal but which, as shown in FIG. 10, leaves the outlet opening 106 uncovered.

There is a supply pipe 112 for introducing a non-oxidizing or inert gas into the enclosure, and an exhaust passage 113 through which gases can be removed from within the enclosure or their removal restricted to generate a superatmospheric pressure within the enclosure. Also passage 113 enables a sub-atmospheric pressure to be maintained in the enclosure by connection with a gas exhaust pump (not shown).

With atmospheric pressure in the enclosure, the level of the molten liquid is constant, but with superatmospheric pressure the level in passage 105 will rise above the level in the remainder of the trough. If a sub-atmospheric pressure is maintained in the enclosure, the level of metal in passage 105 will be depressed below the level in the trough. The molten metal in passage 105 therefore provides a seal between the interior of the apparatus and the opening 105 from which the casting emerges. The emerging strand is designated $S^1$.

In this apparatus, as in the other embodiments, the primary strand is formed from a heat of molten metal, cooled to a condition where it is solidified, and then other metal from the same heat from which the supporting strand was formed, is applied to it, in this case, as in some of the other figures, on both sides at the same time. Cooling elements that may be desirable, such as water-cooled guide rolls in the enclosure, or for supporting the emerging casting, have been omitted from the generally schematic drawings for purpose of clarity. Also the source of pressure gas, which is non-oxidizing and preferably inert, as perhaps argon, or, where the metallurgy permits, nitrogen, have not been shown; and also an exhaust fan connected to exhaust passage 113 has not been shown, since these, per se, involve no element of novelty.

From the foregoing, various embodiments of apparatus disclosing and practising the invention, it will be seen that in each case a primary strand is first formed from a heat of molten metal and then additional molten metal from the same heat is applied to one or both surfaces of the solidified and at least partially primary strand and becomes an integral part of the strand. In some cases the continuously-formed strand may be cut crosswise into convenient lengths for subsequent forging or casting, or it may be slit lengthwise to form bar-stock, or it may pass to a rolling mill for continuous folling into sheets and bars, with an intervening step of reheating if necessary. Also, as previously mentioned, provision for generating an alternating magnetic field to better control the flow and spread of hot metal, especially steel as disclosed in one or the other of said co-pending applications mentioned at the beginning of this specification. Wherever applicable, apparatus or procedures disclosed in one modification may be incorporated in or combined with another or others to take advantage of the desirable features in each. For example, but without limitation, the final strand produced in the apparatus as disclosed in FIGS. 7, 9 and 9, or 10 and 11 could be used to provide the primary strand of FIGS. 1 and 2 or 3 and 4.

I claim:

1. The method of converting molten metal into a solid product having a substantially uniform fine crystalline structure throughout which comprises:

(a) forming at a first casting station a continuous imperforate primary strand of metal of a less thickness than the end product to be formed by moving a chill surface continuously in contact with a pool of molten metal supplied from a source of molten metal to progressively develop a solidified thin layer over said chill surface, (b) continuously stripping the solidified primary layer from the chill surface with the surface which solidified in contact with the chill surface as the inside surface, and the opposite surface the outside surface, (c) moving the strand so formed over a cooled supporting surface with the inside surface contacting the supporting means, (d) cooling the outer surface of the primary strand so formed, (e) then, at a second casting station separated and removed from the first, applying and bonding to the moving cooled outer surface of the primary strand a layer of molten metal from the same source as that supplied to the first station and while the inside surface of the primary strand is supported on the chilled supporting surface, (f) and progressively contacting the outer surface of the molten layer of metal so applied with cooling means to accelerate rapid cooling and crystallization of said layer of molten metal to develope a crystalline grain structrue comparable to that of the primary strand.

2. The method of converting molten metal into a solid product having a substantially uniform fine crystalline structure throughout which comprises:

(a) forming at a first casting station a continuous imperforate primary strand of metal of a less thickness than the end product to be formed by moving a chill surface continuously in contact with a pool of molten metal to progressively develop a solidified thin layer over said chill surface, (b) continuously stripping the solidified primary layer from the chill surface with the surface which solidified in contact with the chill surface as the inside surface, and the opposite surface the outside surface, (c) moving the strand so formed over a cooled supporting surface with the inside surface contacting the supporting means, (d) cooling the outer surface of the primary strip so formed, (e) at a second casting station removed from the first, applying a layer of molten metal from the same source as the first to the then cooled outside surface only of said primary strand, the said outside surface at this station then constituting a moving chill surface, and with the inside surface supported on said chilled supporting means, (f) cooling the metal so applied at the second casting station to inseparably bond it to the outer surface of the first to develop therein by rapid solidification a crystalline grain structure comparable to that of the primary strand.

3. The method of converting molten metal into a solid product as defined in claim 2 in which one additional layer of molten metal from the same source is applied over the surface of the metal last applied to bond thereto and rapidly cooling and solidifying said last applied layer of molten metal from the outer surface inwardly and the underlying layer outwardly.

4. The method defined in claim 2 in which a succession of thin layers of molten metal is applied at spaced intervals, one over the preceding one, each layer of liquid metal so applied being derived from the same source from which the primary strip was formed, and immediately after the application of each layer, rapidly cooling and solidifying the layer of molten metal so applied to develop a desired crystalline structure and provide a chill surface to which the next succeeding layer of molten metal is applied and quickly chilled.

5. The method defined in claim 1 wherein the initial imperforate continuous strand is corrugated in the direction of its length and chilled, and then applying to both corrugated surfaces of the primary strand functioning as chill surfaces molten metal from the same source as the metal from which the primary strand is formed to solidify in said corrugations.

* * * * *